US005775680A

United States Patent [19]

Sorensen et al.

[11] Patent Number: 5,775,680

[45] Date of Patent: Jul. 7, 1998

[54] CLAMP WITH INCLINED SCREW

[75] Inventors: Joseph A. Sorensen, Lincoln; Thomas M. Chervenak, Beatrice; Anthony Fuller, DeWitt; Toby J. Beckmann, Seward, all of Nebr.

[73] Assignee: Petersen Manufacturing, Inc., DeWitt, Nebr.

[21] Appl. No.: 948,757

[22] Filed: Oct. 10, 1997

Related U.S. Application Data

[63] Continuation of Ser. No. 597,595, Feb. 6, 1996, abandoned, which is a continuation of Ser. No. 281,448, Jul. 27, 1994.

[51] Int. Cl.[6] ..... B25B 5/02

[52] U.S. Cl. ..... 269/170

[58] Field of Search ..... 269/166–171.5, 269/147–149, 203–206, 249, 3, 6; 81/487

[56] References Cited

U.S. PATENT DOCUMENTS

| | | |
|---|---|---|
| D. 222,872 | 1/1972 | Boucher . |
| D. 227,192 | 6/1973 | Schafhauser . |
| D. 238,140 | 12/1975 | Guimarin . |
| D. 286,369 | 10/1986 | Hahn . |
| D. 346,942 | 5/1994 | Sawdon . |
| D. 355,104 | 2/1995 | Sorensen et al. . |
| D. 365,263 | 12/1995 | Sorensen et al. . |
| 927,067 | 7/1909 | Offineer . |
| 1,241,215 | 9/1917 | Hoffman . |
| 1,336,755 | 4/1920 | Parmelee . |
| 1,340,092 | 5/1920 | Tuscher, Jr. . |
| 1,783,713 | 12/1930 | Holman et al. . |
| 1,811,518 | 6/1931 | Palmer . |
| 2,133,892 | 10/1938 | Gelinski . |
| 2,815,053 | 12/1957 | Walker . |
| 2,815,778 | 12/1957 | Holman . |
| 3,173,674 | 3/1965 | Ringle . |
| 3,499,206 | 3/1970 | Quernheim . |
| 4,042,264 | 8/1977 | Shumer . |
| 4,083,548 | 4/1978 | Hackbarth . |
| 4,132,397 | 1/1979 | Ward . |
| 4,306,710 | 12/1981 | Vosper . |
| 4,339,113 | 7/1982 | Vosper . |
| 4,989,847 | 2/1991 | Chapman . |
| 5,096,170 | 3/1992 | Albin . |
| 5,197,360 | 3/1993 | Wooster, Jr. . |

FOREIGN PATENT DOCUMENTS

| | | |
|---|---|---|
| 0 274 746 | 7/1988 | European Pat. Off. . |
| 1019277 | 1/1953 | France . |
| 25 39 613 | 3/1977 | Germany . |
| 33 47 232 | 7/1985 | Germany . |
| 8705546 U | 5/1987 | Germany . |

OTHER PUBLICATIONS

"Pony Steel Bar Clamp Fixtures" styles 50, 52 and 56. Publication source and date unknown.

Bessey Steel Bar Clamp Fixture RS 75 instructions. Publication source and date unknown.

Advertisement for Bessey Bar Clamps Styles 52, 53 and 56. Publication source and date unknown.

Advertisement for Bessey Bar Clamps Styles 43 and 35. Publication source and date unknown.

Advertisement for Gross Stabil Clamp. Publication source and date unknown.

"Pony Clamp Fixtures" styles 50, 52, 53 and 56. Jorgensen Style 3500 Aluminum Bar Clamps. Jorgensen Style 7200 Steel I–Bar Clamps. Publication source and date unknown.

*Primary Examiner*—Robert C. Watson

*Attorney, Agent, or Firm*—Brinks Hofer Gilson & Lione

[57] ABSTRACT

A pipe clamp includes a clamp body which supports a screw. A jaw is mounted at one end of the screw and an actuator is used to advance the screw with respect to the clamp body in order to clamp or spread a workpiece with respect to a workpiece-engaging element. The clamp body is movable along the length of the pipe, and the screw is inclined with respect to the pipe to increase clearance for the actuator.

17 Claims, 3 Drawing Sheets

FIG. 1
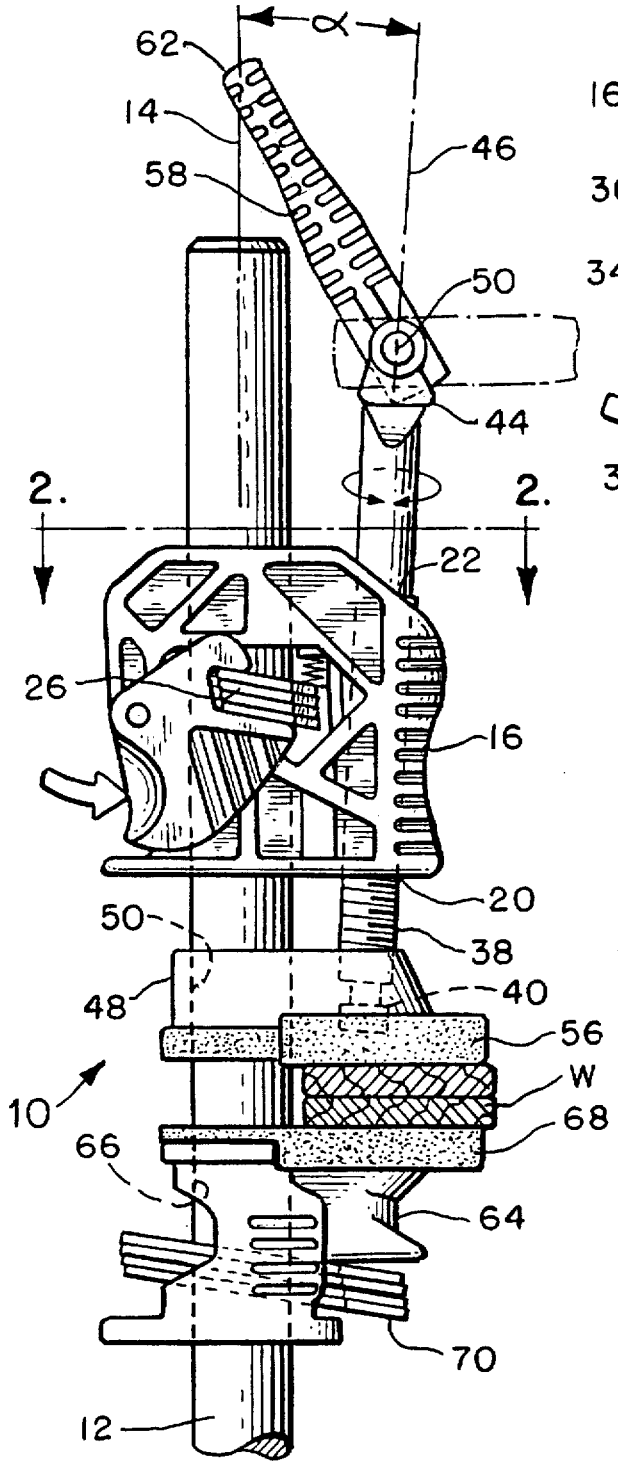
FIG. 4
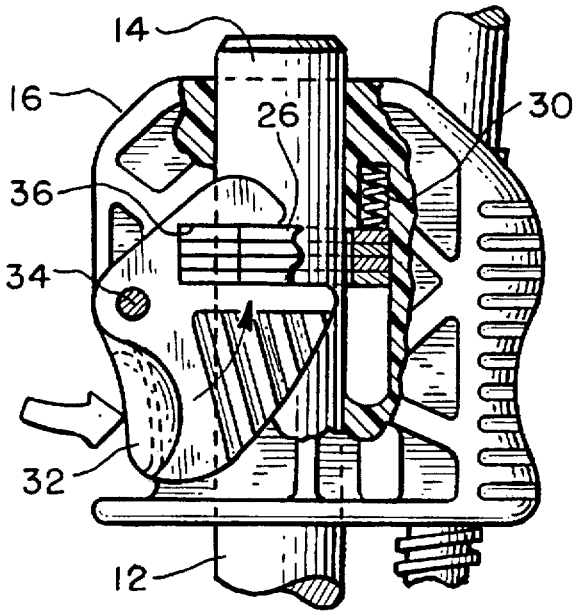
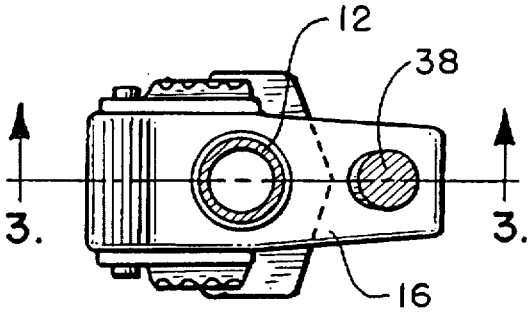
FIG. 2

CLAMP WITH INCLINED SCREW

This application is a continuation of application Ser. No. 08/597,595, filed Feb. 6, 1996, now abandoned, which is a continuation of application Ser. No. 08/281,448, filed Jul. 27, 1994 pending.

BACKGROUND OF THE INVENTION

This invention relates to bar clamps such as pipe clamps, and in particular to bar clamps having an improved clearance between the bar and an actuator such as a handle for operating the clamp.

Pipe clamps such as bar clamps have been widely used in a variety of forms. Offineer U.S. Pat. No. 927,067 discloses a bar clamp having the clamp body connected to a threaded bar such as a pipe at one end. The clamp body supports a lead screw, and a handle protrudes beyond one end of the pipe. The lead screw for the clamp can be inclined with respect to the pipe. Walker U.S. Pat. No. 2,815,053 discloses a bar clamp having clamping surfaces that can be adjusted as to tilt angle by means of threaded shafts.

Neither of these patents addresses the problem solved by this invention, namely the need for increased clearance for an actuator that overlaps the bar in use.

SUMMARY OF THE INVENTION

According to this invention, a clamp is provided comprising a bar defining a bar axis. A clamp body is movable along the bar axis, and a retainer is movably mounted in the clamp body to engage the bar selectively and thereby to hold the clamp body selectively against movement with respect to the bar in at least a first direction along the bar axis. A screw is mounted in the clamp body, and the screw comprises a jaw engaging portion, an actuator engaging portion, and a screw axis extending therebetween. A jaw is mounted to the jaw engaging portion of the screw such that movement of the screw with respect to the clamp body along the screw axis causes the jaw to translate with respect to the clamp body along the bar axis. An actuator is coupled to the actuator engaging portion of the screw for rotation about the screw axis such that rotation of the actuator shifts the screw with respect to the clamp body. A workpiece supporting element is mounted to the bar to oppose the jaw, and the actuator is positioned alongside the bar for at least some positions of the clamp body along the bar axis. The screw axis is tilted with respect to the bar axis such that the actuator engaging portion of the screw at the actuator is farther from the bar than is the jaw engaging portion, thereby providing increased clearance between the actuator and the bar.

As discussed below, this invention can be used in a variety of bar clamps including pipe clamps, and in all cases clearance between the actuator and the bar is increased as compared with a conventional clamp of the type having a screw axis parallel to the bar axis. The actuator can take many forms, including handles that are pivotably mounted to the screw, handles that are rigidly mounted to the screw, and threaded collars that rotate with respect to the screw in use.

BRIEF DESCRIPTION OF THE DRAWINGS

FIG. 1 is a side view of a pipe clamp that incorporates a first preferred embodiment of this invention.

FIG. 2 is a cross-sectional view taken along line 2—2 of FIG. 1.

FIG. 4 is another side view of a portion of the clamp of FIG. 1 showing the retainers positioned to disengage the pipe.

DETAILED DESCRIPTION OF THE PRESENTLY PREFERRED EMBODIMENTS

Figure 3:
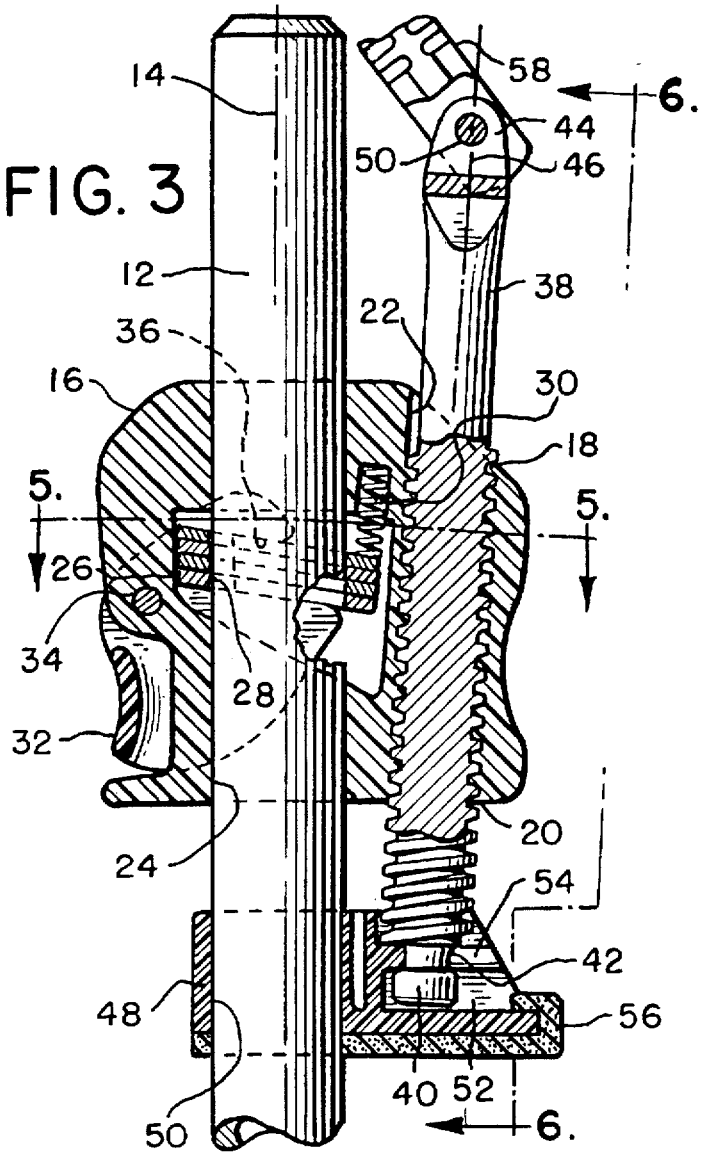
FIG. 3 is a side view at an enlarged scale of a portion of the clamp of FIG. 1.
Figure 6:
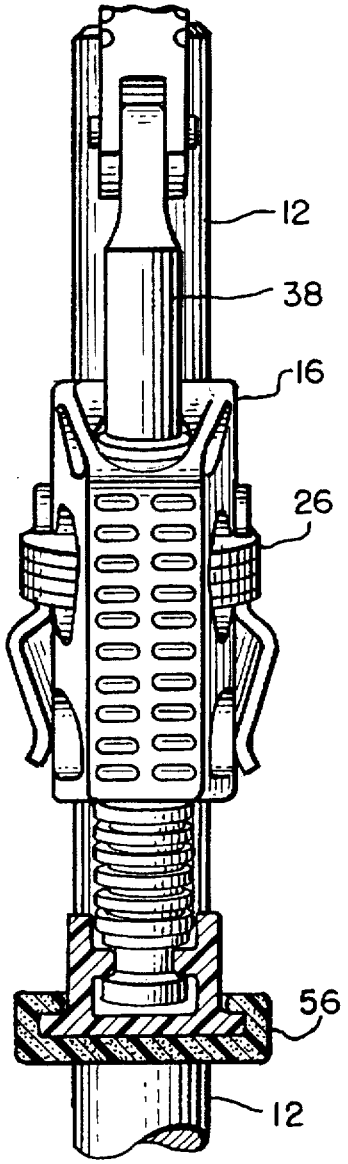
FIG. 6 is a side view taken along line 6—6 of FIG. 3.

Turning now to the drawings, FIG. 1 shows an overall view of a clamp 10 which incorporates a first preferred embodiment of this invention. The clamp 10 includes a bar 12 which in this embodiment is a pipe such as a length of three-quarter inch black pipe having an outside diameter of about 1 inch. Of course, other sizes of pipe and other types of bars can be substituted for the illustrated pipe. The pipe 12 defines a bar axis 14.

Three components are slideably mounted on the pipe 12: a clamp body 16, a jaw 48, and a workpiece engaging element 64. FIGS. 2–6 provide more detailed views of the clamp body 16 on the pipe 12.

As shown in FIG. 3, the clamp body 16 defines a threaded opening 18, which in turn defines a jaw end 20 and a handle end 22. The clamp body 16 also defines an unthreaded opening 24 which receives the pipe 12.

Figure 5:
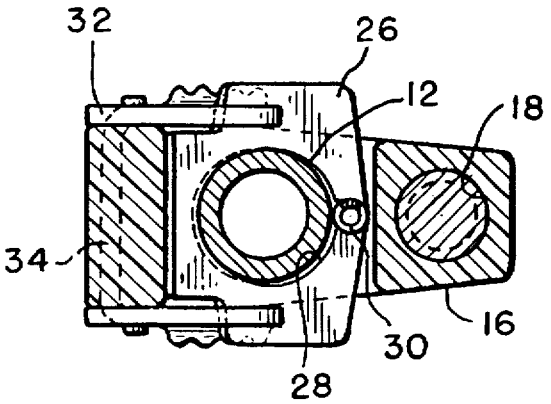
FIG. 5 is a cross-sectional view taken along line 5—5 of FIG. 3.

At least one retainer 26 is mounted in the clamp body 16 in alignment with the unthreaded opening 24 so as to engage the pipe 12. As best shown in FIG. 5, the preferred embodiment uses four parallel retainers 26, each defining a central opening 28 through which the pipe 12 passes. The retainers 26 are biased by a spring 30 to an inclined position as shown in FIG. 3 in which the retainers 26 positively engage the pipe 12 so as to prevent movement of the pipe 12 downwardly as shown in FIG. 3 with respect to the clamp body 16.

The retainers 26 can be released from the pipe 12 by means of a release element 32 which is pivotably mounted to the clamp body 16 at a pivot axis 34. The release element 32 is generally U-shaped in configuration, and it defines recesses 36 that engage the retainers 26 on both sides of the pipe 12.

FIG. 3 shows the release element 32 in its normal or rest position. When desired, a user can rotate the release element 32 about the pivot axis 34 (in a counter-clockwise direction in the view of FIG. 4) so as to move the retainers 26 to a release position, in which the retainers 26 are more nearly perpendicular to the bar axis 14. When so oriented, the retainers 26 release the pipe 12, thereby allowing the user to move the clamp body 16 in either direction as desired along the length of the pipe 12. After the clamp body 16 has been positioned properly, the spring 30 restores the retainers 26 to the inclined position of FIG. 3. The retainers 26 are conventional in the art, and their use and construction are well known to those skilled in the art.

A threaded screw 38 is rotatably mounted in the threaded opening 18 so as to protrude out of both sides of the opening 18. The screw 38 defines a jaw engaging portion 40 which includes a circumferential recess 42. The screw 38 also includes an actuator engaging portion 44 which in this embodiment is flattened and defines an opening for a pivot joint. The screw 38 is rectilinear, and the centerline of the screw 38 forms a screw axis 46 (FIG. 1).

The screw axis 46 is inclined with respect to the bar axis 14 such that the jaw engaging portion 40 of the screw 38 is closer to the pipe 12 than is the actuator engaging portion 44. Similarly, the jaw end 20 of the threaded opening 18 is closer to the pipe 12 than is the handle end 22.

Returning to FIG. 3, a jaw 48 is slideably mounted on the pipe 12. The jaw 48 defines an opening 50 that slidingly receives the pipe 12. The jaw 48 also defines a slot 52 that receives the jaw engaging portion 40 of the screw 38. A ridge 54 on the jaw 48 fits into the circumferential recess 42 of the screw 38. The slot 52 is angled with respect to both the bar axis 14 and the screw axis 46, and the jaw engaging portion 40 is free both to rotate about the screw axis 46 with respect to the jaw 48, and to translate along the slot 52. In this preferred embodiment, the slot is substantially perpendicular to the bar axis 14. A resilient pad 56 is removably mounted on the jaw 48 to engage a workpiece (not shown).

An actuator such as the illustrated handle 58 is mounted on the actuator engaging portion 44 of the screw 38. In this embodiment the actuator 58 is secured to the screw 38 at a pivot joint 50. The actuator 58 defines a free end 62 (FIG. 1) which can be placed on the screw axis 46 when it is desired to rotate the screw 38 rapidly. The actuator 58 can be pivoted to a transverse position as shown in FIG. 1 when it is desired to apply substantial torque to the screw 38 in order to develop clamping forces.

As best shown in FIG. 1, the workpiece engaging element 64 also defines an opening 66 that receives the pipe 12. The workpiece engaging element 64 includes a pad 68 for contacting a workpiece W. Retainers 70 are mounted in the workpiece engaging element 64 to releasably hold the workpiece engaging element 64 from moving away from the clamp body 16.

In use, the clamp body 16 and the workpiece engaging element 64 are positioned appropriately on the pipe 12 to bring the pads 56, 68 closely adjacent to the workpiece W. The handle 58 is then aligned with the screw axis 46 and rotated to develop a slight clamping pressure of the pads 56, 68 against a workpiece W. Then the handle 58 is moved to the transverse position shown in dotted lines in FIG. 1 and torques are applied via the handle 58 to the screw 38 in order to develop the desired clamping pressure.

As the screw 38 is rotated with respect to the clamp body 16 to move the jaw 48 away from the clamp body 16 along the pipe 12, the jaw engaging portion of the screw 38 moves along the slot 52 so as more closely to approach the pipe 12. The retainers 26, 70 engage the pipe 12 to prevent the clamp body 16 and the workpiece engaging element 64, respectively, from moving away from one another along the pipe 12 in response to the clamping forces.

In this embodiment, the included angle $\alpha$ between the bar axis 14 and the screw axis 46 is about 3°. This inclining of the screw axis 46 increases the clearance between the handle 58 and the pipe 12, and thereby facilitates operation of the clamp 10. Of course, this included angle can be increased or decreased as desired from the 30 angle illustrated. In many applications it will be advantageous to have the included angle less than 5°.

In addition to increasing the clearance available for the handle, the arrangement described above provides the further advantage that the jaw engaging portion 40 engages the jaw 48 at a point closer to the pipe 12 than would otherwise be the case. With this arrangement, it is possible to develop clamping forces closer to the pipe 12, which is important for many clamping applications. In addition, by positioning the screw 38 as discussed above, there is less of a tendency for the screw 38 to tilt the jaw 48 with respect to the pipe 12, particularly when clamping narrow workpieces.

The clearance-increasing function of the arrangement discussed above is particularly important in a class of bar clamps such as pipe clamps where the separation between the screw and the clamp is less than 1 inch. In the embodiment described above, when scaled for use with the illustrated pipe, the separation between the pipe and the screw is preferably less than 1 inch, more preferably less than ¾ inch and most preferably no more than about ½ inch. In these situations clearance between the handle and the pipe is severely limited, and the inclined screw described above provides the important advantage of increasing handle clearance.

FIG. 1 shows the clamp 10 arranged to apply a compressive load to a workpiece W. When it is desired to apply a spreading force to a workpiece, the clamp body 16 and the workpiece engaging element 64 can be rearranged on the pipe such that the pads 56, 68 oppose one another facing outwardly rather than facing toward one another as in FIG. 1.

Simply by way of example, the following materials have been found suitable for use in the embodiment described above. The clamp body 16, the workpiece engaging element 64, the jaw 48 and the handle 58 can be injection molded from a suitable material such as a 30% glass-reinforced nylon. The pads 56, 68 can be injected molded of an elastomeric material such as the resin sold by Monsanto under the trade name SANTOPRENE. The retainers 26, 70 can be formed from plate metal such as 1051M steel having a hardness such as RC-50. The screw 38 can be formed of a material such as 1031 steel.

Figure 7:
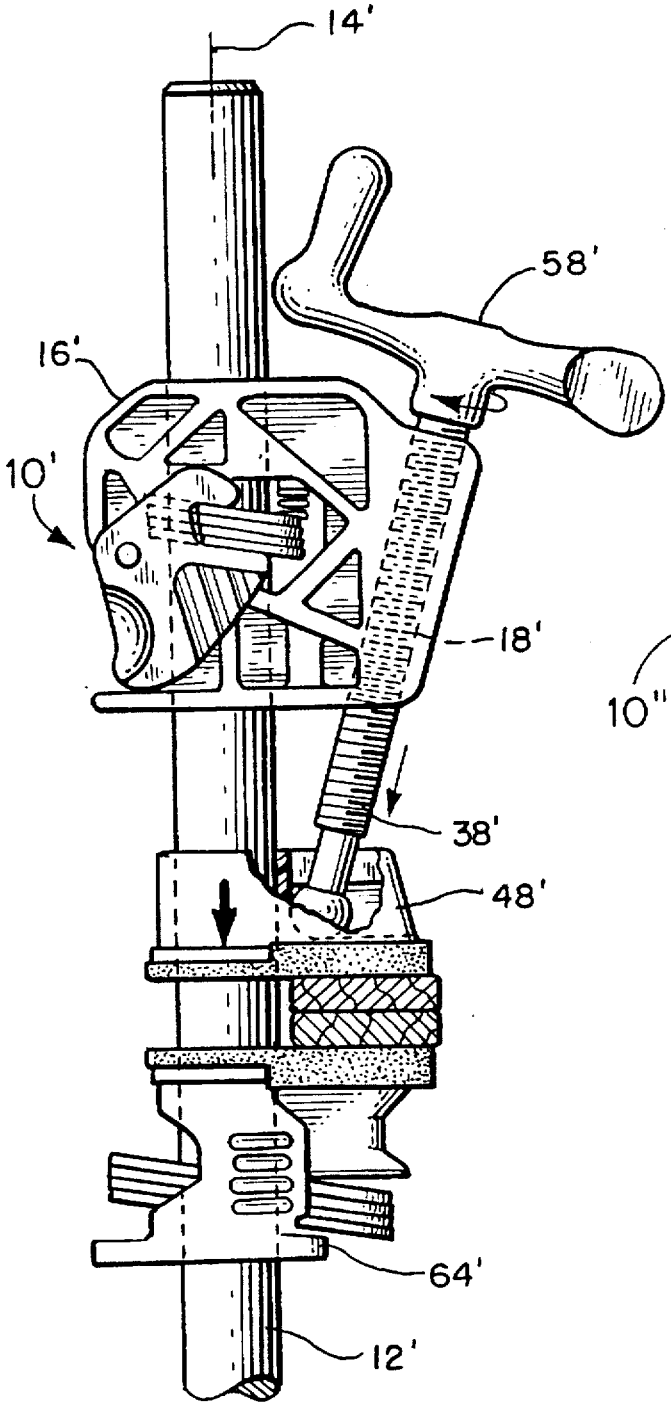
FIG. 7 is a side view of a second preferred embodiment of this invention.

Turning now to FIG. 7, this figure shows a clamp 10' which incorporates a second preferred embodiment of this invention. The clamp 10' is substantially similar to the clamp 10, and the following discussion will focus only on the differences. A key difference is that the clamp body 16' defines a threaded opening 18' that is tilted with respect to the bar axis 14' by an included angle of about 15°. In this case, the screw 38' is connected to the jaw 48' by a ball joint as shown, and the actuator or handle 58' is fixed to the screw 38'. The relatively larger included angle between the screw 38' and the pipe 12' allows a large fixed handle 58' to be used. The workpiece engaging element 64' can be identical to that shown in FIG. 1 above.

Though the included angle between the screw 38' and the pipe 12' is shown as 15°, other included angles greater than 5° can be used as well.

Figure 8:
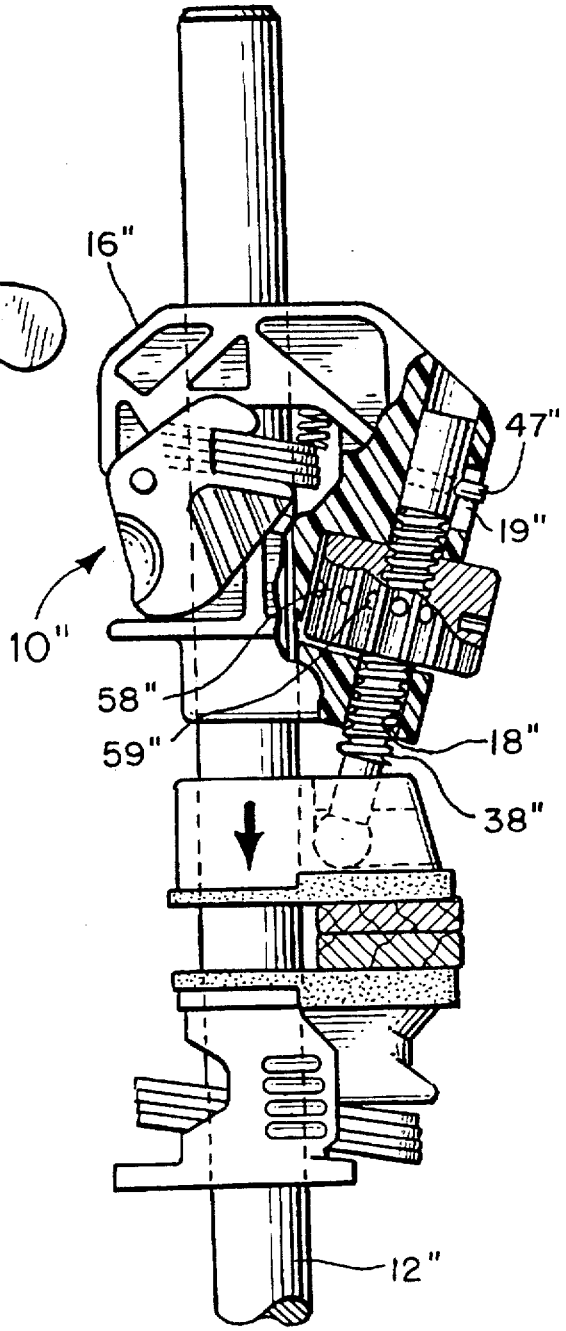
FIG. 8 is a side view of a third preferred embodiment of this invention.

FIG. 8 shows a clamp 10" which incorporates a second preferred embodiment of this invention. As before, components of the clamp 10" which are not significantly different from corresponding components of the clamp 10 will not be discussed in detail, and the following discussion will focus on the differences. In the clamp 10" the clamp body 16" defines an opening 18" which is oriented at a 15° angle with respect to the pipe 12". In this case the opening is not threaded, and a slot 19" is defined by the clamp body 16", extending along a diameter of the opening 18".

In this case, the opening 18" is sized to receive the screw 38" for sliding movement, without any threaded connection between the screw 38" and the clamp body 16". A pin 47" is fixed to the screw 38" to slide in the slot 19". In this way, the screw 38" is prevented from rotating with respect to the clamp body 16".

In this case the actuator 58" is formed as a rotating collar having a threaded opening that receives the screw 38". Wrench openings 59" are provided around the circumference of the actuator 58" to assist the user in applying large torques to the actuator 58".

As in the preceding example, the included angle between the screw 38" and the pipe 12" is in this embodiment 15°, though other angles greater than about 10° are suitable. The actuator 58" is rotated in order to advance and retract the screw 38" with respect to the clamp body 16". The inclined screw 38" allows a larger diameter actuator 58" to be used, once again improving handle clearance.

It should be apparent from the foregoing detailed description that a wide range of changes and modifications can be made to the preferred embodiments described above. For example, the workpiece engaging element 64 may be fixedly instead of movably mounted on the bar. Also proportions, dimensions and materials may be adapted widely as appropriate for the particular application. It is therefore intended that the foregoing detailed description be regarded as illustrative rather than limiting. It should be understood that the following claims, including all equivalents, are intended to define the scope of this invention.

We claim:

1. A clamp comprising:

a bar defining a bar axis;

a clamp body movable along the bar axis;

a retainer movably mounted in the clamp body to engage the bar selectively and thereby to hold the clamp body selectively against movement with respect to the bar in at least a first direction along the bar axis;

a screw mounted in the clamp body, said screw comprising a jaw engaging portion, an actuator engaging portion, and a screw axis extending therebetween;

a jaw guided by the bar for movement along the bar axis, said jaw mounted to the jaw engaging portion of the screw such that movement of the screw with respect to the clamp body along the screw axis causes the jaw to translate with respect to the bar and the clamp body along the bar axis, wherein the jaw defines a slot angled with respect to both the screw axis and the bar axis, and wherein the jaw engaging portion of the screw moves along the slot toward the bar as the jaw engaging portion of the screw moves away from the clamp body;

an actuator coupled to the actuator engaging portion for rotation about the screw axis such that rotation of the actuator shifts the screw with respect to the clamp body;

a workpiece supporting element mounted to the bar to oppose the jaw;

wherein the actuator is positioned alongside the bar for at least some positions of the clamp body along the bar axis; and wherein the screw axis is tilted with respect to the bar axis such that the actuator engaging portion of the screw at the actuator is farther from the bar than is the jaw engaging portion, thereby providing increased clearance between the actuator and the bar.

2. The clamp of claim 1 wherein the actuator comprises a handle secured to the screw to rotate in unison with the screw.

3. The clamp of claim 2 wherein the clamp body defines a threaded opening that receives the screw such that rotation of the screw with respect to the clamp body moves the screw along the screw axis with respect to the clamp body.

4. The clamp of claim 1 wherein the jaw and the workpiece supporting element are oriented to compress a workpiece therebetween.

5. The clamp of claim 1 wherein the bar comprises a pipe.

6. The clamp of claim 1 wherein the screw axis and the bar axis define an included angle that is less than 5°.

7. The clamp of claim 1 wherein the screw axis and the bar axis define an included angle that is greater than 5°.

8. The clamp of claim 1 wherein the actuator defines a threaded opening that receives the screw, and wherein the actuator is rotatably mounted on the clamp body such that rotation of the actuator with respect to the clamp body moves the screw along the screw axis with respect to the clamp body.

9. The clamp of claim 1 wherein the jaw defines an opening that receives the bar.

10. The clamp of claim 1 wherein the jaw comprises a ridge adjacent to the slot, and wherein the screw defines a circumferential recess that receives the ridge to link the screw to the jaw while accommodating rotation of the screw and movement of the screw along the ridge.

11. A pipe clamp comprising:

a pipe;

a clamp body movable along the pipe, said clamp body comprising a threaded opening and an unthreaded opening; said threaded opening comprising a jaw end and a handle end, said threaded opening tilted with respect to the pipe such that the jaw end is closer to the pipe than is the handle end, said unthreaded opening receiving the pipe;

at least one retainer positioned around the pipe, coupled to the clamp body, and movable between an inclined position, in which the retainer holds the clamp body against movement in at least a first direction with respect to the pipe, and a release position, in which the retainer accommodates movement of the clamp body in the first direction with respect to the pipe;

a screw mounted in the threaded opening to extend outwardly from the jaw end and the handle end;

a handle mounted to the screw near the handle end to rotate with the screw;

a jaw mounted to the screw near the jaw end, said jaw encircling the pipe to guide the jaw for movement along the pipe and to prevent rotation of the jaw with respect to the pipe, said screw operative to move the jaw along the pipe with respect to the clamp body, wherein the jaw defines a slot angled with respect to both the pipe and the screw, and wherein the screw moves along the slot toward the pipe as the screw is rotated to move the jaw away from the clamp body;

a workpiece supporting element mounted to the pipe to oppose the jaw;

wherein the handle is positioned alongside the pipe for at least some positions of the clamp body along the pipe; and wherein the tilted threaded opening provides increased clearance between the pipe and the handle.

12. The clamp of claim 11 wherein the jaw and the workpiece supporting element are oriented to compress a workpiece therebetween.

13. The clamp of claim 11 wherein the threaded opening and the pipe define an included angle that is less than 5°.

14. The clamp of claim 11 wherein the jaw comprises a ridge adjacent to the slot, and wherein the screw defines a circumferential recess that receives the ridge to link the screw to the jaw while accommodating rotation of the screw and movement of the screw along the ridge.

15. The clamp of claim 11 wherein the handle is pivotably mounted to the handle end of the screw.

16. The clamp of claim 1 wherein the slot allows movement of the jaw engaging portion of the screw with respect to the jaw toward and away from the bar axis.

17. The clamp of claim 11 wherein the slot allows movement of the screw with respect to the jaw toward and away from the pipe.

* * * * *